United States Patent [19]

Garvison

[11] Patent Number: 4,539,968

[45] Date of Patent: Sep. 10, 1985

[54] BOWSTRING RELEASE DEVICE

[76] Inventor: Geary L. Garvison, 410 N. Shore Dr., South Haven, Mich. 49090

[21] Appl. No.: 418,791

[22] Filed: Sep. 16, 1982

[51] Int. Cl.[3] ..... F41B 5/00

[52] U.S. Cl. ..... 124/35 A

[58] Field of Search ..... 124/35 A, 23 R, 24 R

[56] References Cited

U.S. PATENT DOCUMENTS

| | | | |
|---|---|---|---|
| 2,819,707 | 1/1958 | Kayfes et al. | 124/35 A |
| 3,998,202 | 12/1976 | Boyko | 124/35 A |
| 4,041,926 | 8/1977 | Troncoso | 124/35 A |

*Primary Examiner*—Richard J. Apley

*Assistant Examiner*—William R. Browne

*Attorney, Agent, or Firm*—Gordon W. Hueschen

[57] ABSTRACT

There is disclosed an archery release mechanism for releasing the bowstring of a free-standing bow in which a latch mechanism for latching onto the bowstring has a wrist band for attaching it to the wrist of the archer. The latch mechanism has a trigger adapted to engage the latch mechanism and hold it in latching position when the trigger is fully retracted so that the bowstring is released when the trigger is released. The latch mechanism is constructed also so that the latching mechanism is held in latch position when the trigger is not retracted so that the bowstring can be released by a pull of the trigger.

14 Claims, 9 Drawing Figures

BOWSTRING RELEASE DEVICE

BACKGROUND OF THE INVENTION

Field of Invention and Prior Art

The invention relates to an archery release mechanism for a free-standing bow.

Archery release mechanisms for crossbows are common. However, archery release mechanisms for free-standing bows are not; and those that are available, for example, U.S. Pat. No. 3,757,763, granted to Ross A. Pinti and U.S. Pat. No. 3,929,120, granted to Roland K. Barner, suffer the disadvantage of complicating the draw of the bow and the release of the bowstring.

OBJECTS OF THE INVENTION

It is an object of the invention to provide an improved archery release mechanism for free-standing bows. Another object of the invention is to provide an archery release mechanism for free-standing bows which is easily and quickly attachable to the bowstring. It is a further object of the invention to provide an archery release mechanism for free-standing bows which makes it simple and easy to draw the bow and to release the arrow. Still another object of the invention to provide an archery release mechanism for free-standing bows to take advantage of the natural instinct of the archer to pull back and release in effecting the draw of the bow and the release of the arrow. Further objects of the invention are to avoid the disadvantages of the prior art and to obtain such advantages as will appear as the description proceeds.

SUMMARY OF THE INVENTION

The invention relates to an archery release mechanism for a free-standing bow, which comprises:

bowstring-engaging and releasing latch means;

trigger means having a movable finger piece normally spring-biased to a forward position and adaped to be pulled back to a rearward position by a finger of the archer;

complementary detents on said trigger means and said latch means which are operative in the rearward position of said finger piece to hold said latch means in bowstring-engaging position and which become disengaged when said finger piece is released and allowed to be moved toward the forward position by said spring, thereby allowing said latch means to move to bowstring-releasing position; and, holding means for holding said trigger means and said latch means in operative position.

Advantageously, the holding means has an elongate forward portion having a longitudinal bowstring-receiving slot therein and in which said latch means in the bowstring-engaging position blocks said slot and the latch means comprises a cocking arm forming a v-shaped notch between them and being mounted for rotation about a pivot from a position in which said cocking arm is transverse to said slot in position to be engaged by said bowstring to a position in which said latch arm is transverse to said slot.

The seasoned archer has been trained through long usage of his bow to use several of his fingers in pulling back the bowstring. Hence, when a seasoned archer obtains an archery release mechanism which requires that he hold one finger free while drawing and use it to pull the trigger to release the bowstring, he is going against all his previous training. No matter how skillful he is in doing this, there will come a time when, under the stress of sighting game, he will revert to his previous training and pull back on the trigger, thus, inadvertently releasing the arrow before the bow is drawn. This drawback is avoided by arranging the detents in the archery release mechanism of the invention in such a manner that the bow release is held in cocked position when the trigger is pulled back so that the archer pulls back with all his fingers and effects release of the arrow at the desired time by lifting the trigger finger off the trigger.

If desired, there may be provided a second pair of complementary detents in the archery release mechanism of the invention, so that the archer is given the option of effecting release of the bowsting when the trigger is pulled back or, when it is released from the pulled-back portion.

In accordance with the preferred aspects of the archery release mechanism according to the invention, there may be incorporated one or more further features in which said latch is mounted to rotate about a pivot point so located that the latching arm, in the cocked position, blocks the slot and acts to retain the bowstring in said slot until the trigger is released, whereupon it rotates to the release position and releases the bowstring, which further comprises limiting means for limiting the rotation of said rotary latch; in which said limiting means comprises holding means for holding said rotary latch in a release position in which said latching arm is free of said slot so that said slot can be easily and quickly engaged on said bowstring and, with said cocking arm in position to be engaged by said bowstring, to move said latching arm to the cocked position and to trap the bowstring in said slot; in which said holding means comprises surfaces on said trigger adapted to abut surfaces on said rotary latch, one of which is on one side of the pivot point and the other of which is on the other side of the pivot point; and, in which said rotary latch has a curved cam surface sloping from the bottom of said latch to a point substantially opposite the pivot point and said trigger has a cam-rider surface adapted to be engaged by said cam, whereby rotation of said rotary latch toward the cocked position causes said trigger to be moved toward its backward position.

DESCRIPTION OF THE PREFERRED EMBODIMENTS

Figure 1:
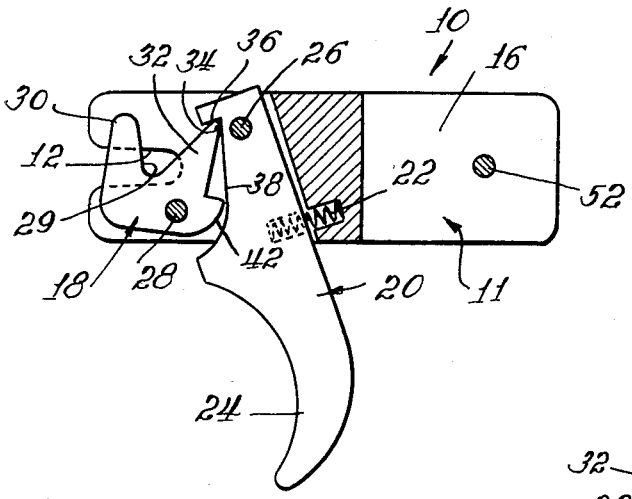
FIG. 1 is a detail view with the front half cut away to show the rotary latch in cocked position with the trigger pulled back.
Figure 3:
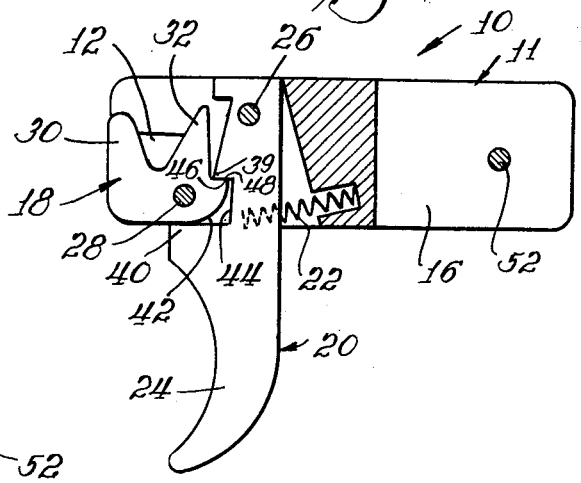
FIG. 3 is a like view of a modified form in cocked position with the trigger in its forward position.
Figure 4:
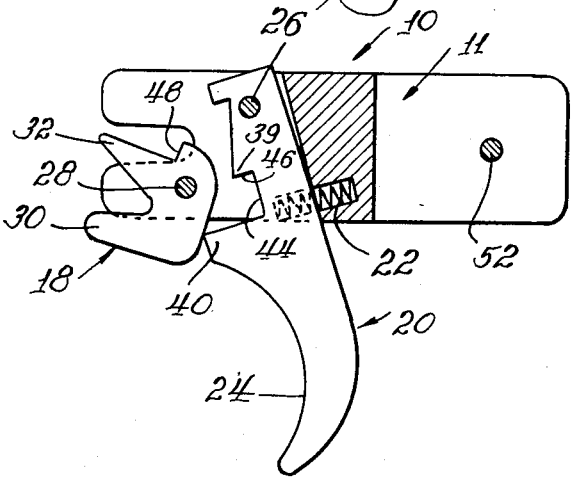
FIG. 4 is a like view of the modified form showing the rotary latch in fully-released position when the trigger is fully drawn back.

Referring now particularly to FIGS. 1, 2, 7, 8, and 9, there is shown a release mechanism 10 comprising a casing or housing 11 having a transverse bow-receiving slot 12, a longitudinal, latch-receiving slot 14, and a longitudinal anchoring slot 16. The latter is intended to receive a strap or cord or the like 15, for fastening the release mechanism 10 to a wristband 17 for attaching the device to the wrist of the archer.

Pivoted in the latch-receiving slot 14 is a rotary latch 18 and a pivoted trigger 20, spring-biased to forward position by spring 22.

For the purpose of description, the finger portion 24 of the trigger will be considered down, since that will be the normal position when the mechanism is nocked on the bowstring. It will be understood, however, that, in the actual release position, the finger portion 24 will project to the right for a right-handed archer and to the left for a left-handed archer.

The cord 15 makes it possible to rotate the mechanism 10 from the position shown, which adopts the device for a left-handed archer, 180° to adapt it to a right-handed archer.

The trigger 20 is pivoted at 26 near the top of the housing 11, and the rotary latch 18 is pivoted at 28 near the bottom of the housing 11. The pivot 26 is above the slot 12 and the pivot 28 is below it.

The rotary latch 18 has a v-shaped notch 29 in it forward of the pivot point 28, forming a bow-retaining arm 30 and a cocking arm 32. When the bowstring enters the slot 12, it engages the cocking arm 32 and pushes it back toward the trigger mechanism. The arm 32 and the trigger 20 have complementary detents 34 and 36 so arranged that, in the cocked position of the rotary latch 18, the detent 34 is engaged by the detent 36, so that the rotary latch is held in cocked position as long as the finger portion 24 of the trigger is held back in the position shown in FIG. 1.

Figure 2:
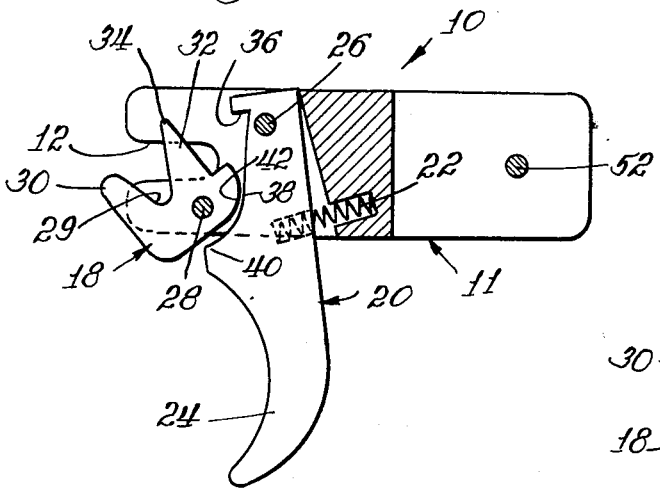
FIG. 2 is a like view showing the rotary latch in release position resulting from release of the trigger in FIG. 1.
Figure 5:
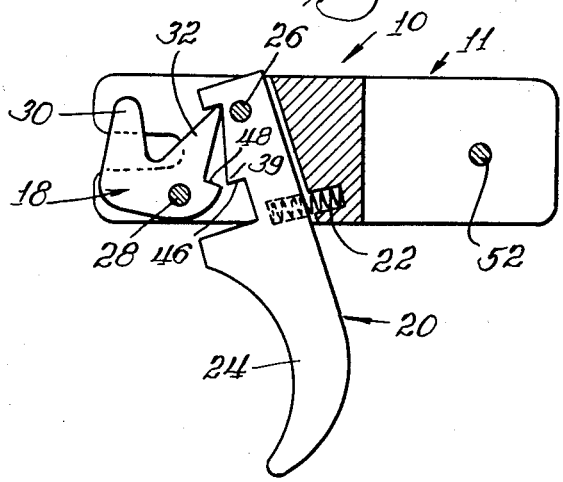
FIG. 5 is a like view of the modified form in cocked, position with the trigger pulled back.
Figure 6:
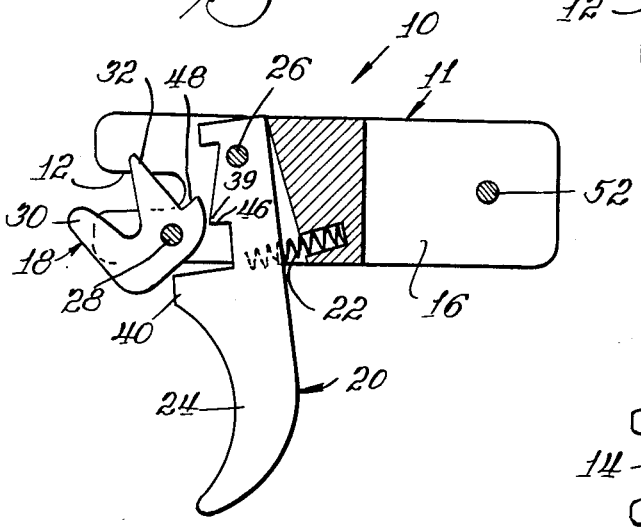
FIG. 6 is a like view of the modified form when both the rotary latch and the trigger has been released.
Figure 7:
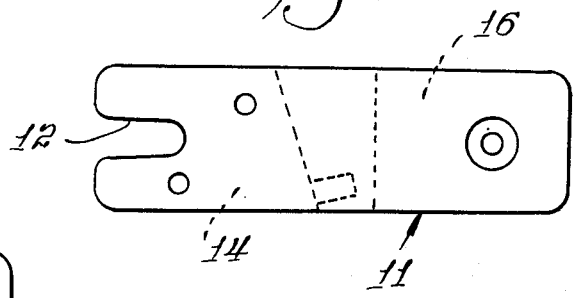
FIG. 7 is a side view of the casing or housing which houses the trigger and release mechanism; and, FIG. 8 is a plan view thereof.
Figure 8:
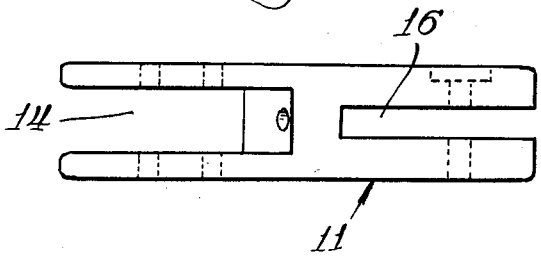
Figure 9:
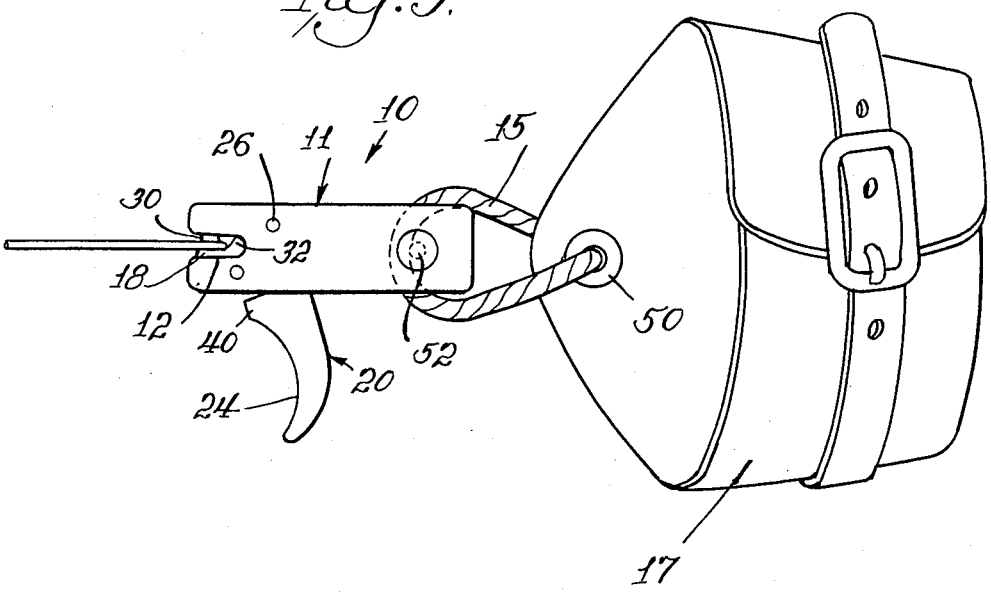
FIG. 9 is a side view of FIG. 5 attached to a wrist band.

Thus, in the operation of the modification just described, a bowstring is inserted into the slot 12, engages the cocking arm 32 and forces it back into engagement with the trigger so that, when the trigger portion is pulled back, the detent 34 is engaged by the detent 36 and the rotary latch 18 is held in cocked position and, on releasing the trigger, detent 34 is disengaged and the bowstring is released, whereupon the rotary latch rotates to the position shown in FIG. 2 and is held there by the portions 38 and 40 thereof engaging the rotary latch on opposite sides of the pivot point 20.

The rotary latch 28 has a curved cam surface 42 which slopes from the bottom of the latch to a point substantially opposite the pivot 28. Thus, on rotation of the rotary latch 18 to the latch position, the cam surface 42 engages portion 38 of the trigger, thus forcing it back to a position where the detent 36 engages the detent 34 when finger portion 24 is fully pulled back.

In the modified form shown in FIGS. 3, 4, 5, and 6, the trigger is undercut opposite pivot point 28 having projections 39 and 40 which form notch 44 adapted to receive the curved cam surface 42. Thus, the flat surface 46 of the notch 44 and the flat portion 48 of the cam 42 form complementary detents which overlap in the position shown in FIG. 3 and hold the rotary latch 18 in the cocked position shown in FIG. 3. When the trigger is pulled to the position shown in FIG. 4, the bowstring is released and the rotary latch rotates to the position there shown, with its bottom surface in contact with the projection 40. And when the trigger is released, it rotates back to the position shown in FIG. 6, where the projection 39 and the projection 40 engage the rotary latch 18 on opposite sides of the pivot 28.

The release mechanism 10 is fastened to the wristband 17 by means of a looped cord or thong 15 which is threaded through a grommet 50 in the wristband and is held in anchoring slot 16 by a suitable pin 52. There is thus provided an archery release device in which the release mechanism is fastened to the wrist of the archer in position to lie in the palm of the archer's hand where the trigger can be pulled back readily by one or more fingers of the archer. Thus, the stress engendered by drawing the bow is sustained by the forearm of the archer and the fingers are free to manipulate the trigger independent of this stress. Consequently, when the mechanism is held in bowstring-engaging position by the pulled-back trigger, the bow is fully drawn, the bowstring can be released by releasing the finger pressure on the trigger by the same type of motion that is used in drawing and releasing a bowstring by the fingers in the usual manner. However, the fingers are not stressed as they are in such case, so that a smooth uniform release is consistently obtained.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. In a bowstring release device for engaging and releasing a bowstring, the improvement which comprises:

bowstring-engaging and releasing latch means adapted to engage and release a bowstring;

trigger means for actuating said latch means having a spring, a movable finger piece normally spring-biased by a spring to a forward position and adaped to be pulled back to said rearward position by a finger of the archer;

complementary detents on said trigger means and said latch means which are engaged in the rearward position of said finger piece to hold said latch means in bowstring-engaging position and which become disengaged when said finger piece is released and allowed to be moved toward the forward position by said spring, thereby allowing said latch means to move to bowstring-releasing position; and, casing means for holding said trigger means and said latch means in operative position.

2. A bowstring release device according to claim 1, in which said casing means has an elongate forward portion having a longitudinal bowstring-receiving slot therein and in which said latch means in a bowstring-engaging position blocks said slot.

3. A bowstring release device according to claim 2, in which said latch means comprises a rotary latch having a latching arm and a cocking arm forming a v-shaped notch between them and being mounted for rotation about a pivot from a position in which said cocking arm is transverse to said slot in position to be engaged by a bowstring to a position in which said latching arm is transverse to said slot.

4. A bowstring release device according to claim 3, which further comprises limiting means for limiting the rotation of said rotary latch which comprises holding means for holding said rotary latch in a release position in which said latching arm is free of said slot so that said slot can easily and quickly be engaged on a bowstring and, with said cocking arm in position to be engaged by a bowstring, to move said latching arm to the cocked position and to trap a bowstring in said slot.

5. A bowstring release device according to claim 4, in which said holding means comprises surfaces on said trigger means adapted to abut surfaces on said rotary latch, one of which is on one side of the said pivot of said latch and the other of which is on the other side of said pivot.

6. A bowstring release device of claim 5, in which said rotary latch has a curved cam surface sloping from the bottom of said latch to a point substantially opposite the pivot point of said latch and said trigger means has a cam-rider surface adapted to be engaged by said cam surface, whereby rotation of said rotary latch toward the cocked position causes said finger piece to be moved toward its rearward position.

7. A bowstring release device of claim 3, in which said rotary latch has a curved cam surface sloping from the bottom of said latch to a point substantially opposite the said pivot of said latch and said trigger means has a cam-rider surface adapted to be engaged by said cam surface, whereby rotation of said rotary latch toward the cocked position causes said finger piece to be moved toward its rearward position.

8. A bowstring release device of claim 3, which comprises further complementary detents so located that said rotary latch is held in the cocked position when said trigger means is not pulled back, said first complementary detents functioning independently of said second complementary detents and vice versa, so that the rotary latch can be held in cocked position in either the forward or rearward positions of the finger piece, whereby the archer has the option to effect release of a bowstring, either by pulling on the finger piece when it is not pulled back or by releasing it when it is pulled back.

9. A bowstring release device according to claim 8, which further comprises limiting means for limiting the rotation of said rotary latch which comprises holding means for holding said rotary latch in a release position in which said latching arm is free of said slot, so that said slot can be easily and quickly engaged on a bowstring and with said cocking arm in position to be engaged by a bowstring, and to move said latching arm to the cocked position and to trap a bowstring in said slot.

10. A bowstring release device according to claim 9, in which said holding means comprises surfaces on said trigger means adapted to abut surfaces on said rotary latch, one of which is on one side of said pivot and the other of which is on the other side of said pivot.

11. A bowstring release device of claim 3, in which one of said complementary detents is the tip of said cocking arm and the other is on said trigger means, so located and so shaped that pulling the finger piece back moves said other detent into position to engage the tip of said cocking arm when it is in cocked position and to hold it in cocked position until the finger piece is released.

12. A bowstring release device of claim 2, which further comprises means on said trigger means adapted, in the release position, to engage said latch means and hold it in position which does not block said slot.

13. A bowstring release device for drawing and releasing a bowstring, which comprises in combination:

a bowstring draw and release mechanism which comprises a finger piece spring-biased to forward position and means adapted to maintain said mechanism in bowstring-drawing mode when the finger piece is pulled back and in bowstring-releasing mode when said finger piece is released;

attaching means for attaching said mechanism to the wrist of the archer in a position relative to said mechanism such that the finger piece can be held back by one or more of the archer's fingers and such that when a bowstring is drawn, the stress of holding a bowstring in drawn position is borne substantially completely by said attaching means and substantially the only stress on the fingers in pulling back a bowstring is that engendered by the spring-biasing of the finger piece and the archer effects release of a bowstring by the same general type of motion of the fingers that is used in drawing and releasing a bowstring by the fingers in the usual manner.

14. An archery release device for drawing and releasing a bowstring, which comprises:

a latch mechanism for engaging a bowstring during the draw;

trigger means for actuating said latch means having a movable finger piece normally spring-biased to a forward position and adaped to be pulled back to a rearward position by a finger of the archer; and means for holding said latch mechanism in latched position when said finger piece is in the rearward position but in release position when said finger is in the forward position, whereby the archer draws a bowstring with the finger piece pulled back to the rear position and releases a bowstring by releasing the finger piece.

* * * * *